United States Patent [19]

Puybaraud

[11] Patent Number: 4,462,189

[45] Date of Patent: Jul. 31, 1984

[54] GRINDING TOOL WITH RADIALLY SHIFTABLE ABRASIVE BARS

[75] Inventor: Guy H. Puybaraud, Courcouronne, France

[73] Assignees: S.A. Automobiles Citroen; Societe Automobiles Peugeot, both of Paris, France

[21] Appl. No.: 367,001

[22] Filed: Apr. 9, 1982

[30] Foreign Application Priority Data

Apr. 17, 1981 [FR] France ..... 81 08152

[51] Int. Cl.[3] ..... B24B 33/02

[52] U.S. Cl. ..... 51/338

[58] Field of Search ..... 51/338, 339, 340, 341, 51/342, 343, 344, 345

[56] References Cited

U.S. PATENT DOCUMENTS 3,626,437 12/1971 Staples ..... 51/338

4,075,794 5/1976 Blaylock ..... 51/204 X

FOREIGN PATENT DOCUMENTS 600930 6/1957 Canada ..... 51/345

*Primary Examiner*—Frederick R. Schmidt

*Assistant Examiner*—Judy J. Hartman

*Attorney, Agent, or Firm*—Karl F. Ross

[57] ABSTRACT

A grinding tool with a cylindrical sleeve, having several longitudinally extending slots penetrated by radially shiftable wedge-shaped bars with abrasive outer faces, is provided with a mandrel received in the sleeve and axially displaceable therein for shifting the bars radially outward and inward. The mandrel has longitudinal guide grooves with sloping bottoms, engaged by the correspondingly sloping inner faces of respective bars, and a shallower annular groove of frustoconical bottom intersecting these guide grooves; segments of a frustoconical ring, lodged in the annular groove and projecting into the intersecting guide grooves, engage in mortises of adjacent flanks of respective bars sliding in the guide grooves for positively shifting the bars when the mandrel is displaced in one of the other axial direction.

4 Claims, 4 Drawing Figures

GRINDING TOOL WITH RADIALLY SHIFTABLE ABRASIVE BARS

FIELD OF THE INVENTION

My present invention relates to a grinding tool adapted to be mounted on a grinding machine, comprising a cylindrical sleeve with slots penetrated by wedge-shaped bars whose outer face is abrasive and which are radially shiftable in their slots under the control of an expansion element in the shape of a mandrel that is axially shiftable in the sleeve and has longitudinally extending sloping guide surfaces.

BACKGROUND OF THE INVENTION

In the operation of a tool of this type, the mandrel is connected to an expansion rod of the grinding machine. As the mandrel penetrates further into the sleeve, its sloping surfaces move the bars radially outward as the tool expands. When the tool comprises springs which tend to hold the bars against the sloping guide surfaces and which retract these bars inward when the mandrel is withdrawn, the radial position of the bars and consequently the working diameter of the tool are positively determined when the mandrel is thrust forward but not when it is withdrawn; this is due to the frictional resistance opposing the retraction of the bars.

OBJECT OF THE INVENTION

It is the object of my present invention to provide an improved grinding tool having simple means for positive bidirectional radial shifting of the abrasive bars.

SUMMARY OF THE INVENTION

A grinding tool according to my invention has a mandrel with an annular groove having a frustoconical bottom whose generatrices have the same inclination as the sloping guide surfaces adjoining that groove. Segments of a frustoconical ring complementary to the groove are received therein and project into mortises on the flanks of adjacent bars parallel to the guide surfaces. These segments maintain the bars in contact with the guide surfaces so that they are positively displaced radially by the mandrel upon movement thereof in either direction.

BRIEF DESCRIPTION OF THE DRAWING

The above and other features of my invention will now be described in detail with reference to the accompanying drawing in which.

SPECIFIC DESCRIPTION

Figure 1:
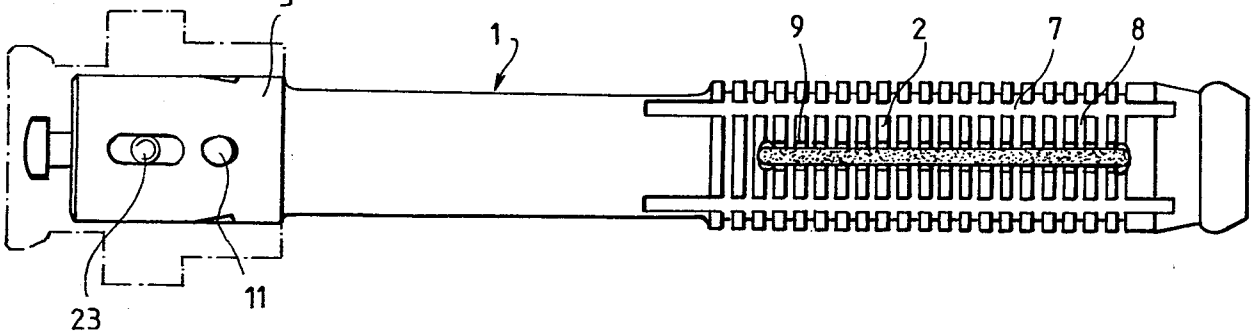
FIG. 1 is an elevational view of a grinding tool embodying the invention.

The grinding tool shown in the drawing comprises a cylindrical body or sleeve 1 with an active forward part 2 and a control head 3. This body has a rear cylindrical bore 4 in the control head and a front cylindrical bore 5 of smaller diameter in the active part; the two bores 4 and 5 communicate with each other and are separated by a shoulder 6.

The active part 2 may be externally protected by a diamond coating and is formed with four longitudinal grooves 7 and a multiplicity of circumferential grooves 8; it further has longitudinal slots 9 opening radially into bore 5. The slots 9 have a length slightly shorter than the active part of the sleeve and respective wedge-shaped bars 10 whose length and thickness virtually equal the length and the width of these slots.

The control head 3 of the sleeve 7 is secured by screws 11 to a centering unit 12 for rotating it.

Axially displaceable inside the sleeve 1 is an expansion element or mandrel 13 comprising a control head 14 and an active forward part 15 respectively aligned with the corresponding parts 3, 2 of the sleeve.

Figure 3:
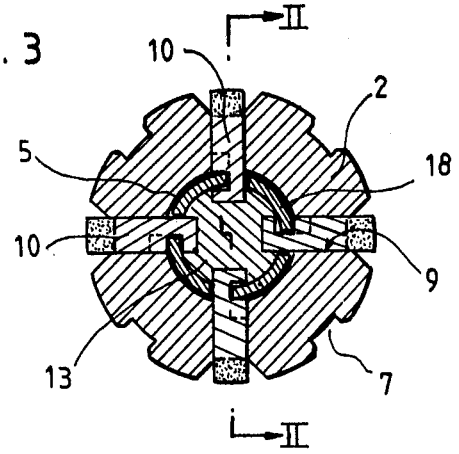
FIG. 3 is a cross-sectional view taken on the line III—III of FIG. 2.
Figure 4:
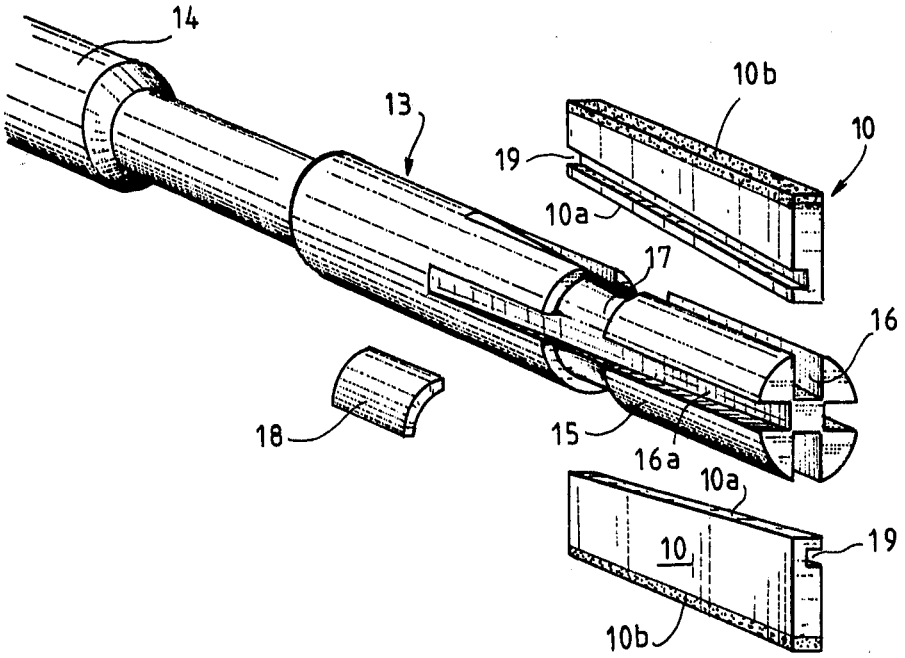
FIG. 4 is an exploded view showing some of the principal components of the tool.

The active part 15 of the mandrel is constituted by a cylinder having the same diameter as the bore 5 in the forward part 2 of the sleeve. This cylinder has as many longitudinal guide grooves 16 with sloping bottoms as there are bars 10 in sleeve 1. These guide grooves 16 have the same width as the bars 10 respectively engaging therein. The bars 10, which are trapezoidal in outline, each have a sloping inner face **10*a* of the same inclination as the bottoms of the grooves 16 so that they may slide radially in the slots and longitudinally in these guide grooves; the opposite outer face 10*b* of each bar is diamond-coated to have an abrasive effect upon an engaged workpiece. The mandrel 13 is further provided, substantially in the median part of its active zone, with an annular peripheral groove having a frustoconical bottom of the same inclination relative to the sleeve axis as the groove 16 but less deep than the latter. Four segments 18, cut from a frustoconical ring complementary to groove 17, are received in the groove and are retained therein by gluing. As best seen in FIG. 3, each segment 18 has a lateral edge projecting into one of the guides 16, intersecting the groove 17, and into a longitudinally extending mortise 19 on an adjacent flank of a bar 10 sliding in that guide groove, these mortises being parallel to the sloping faces 10*a*** of the bars.

When the mandrel 13 is thrust forward within sleeve 1, it drives the bars 10 radially outward as the segments 18 rigid with the mandrel slide in the mortises 19 of the bars. When the mandrel 13 is withdrawn, the segments 18 retract the bars 10 in the radially inward direction. In this way, the bars are controlled positively by the mandrel with either direction of displacement thereof.

The head 14 of the mandrel 13 has a bore with a tapped part engaged by a threaded extremity 21 of a coupling rod connected to the expansion control of the machine. A setscrew 23 bearing on a flat portion of the rod prevents rotation thereof, with reference to the mandrel, after adjustment of their relative axial position.

Figure 2:
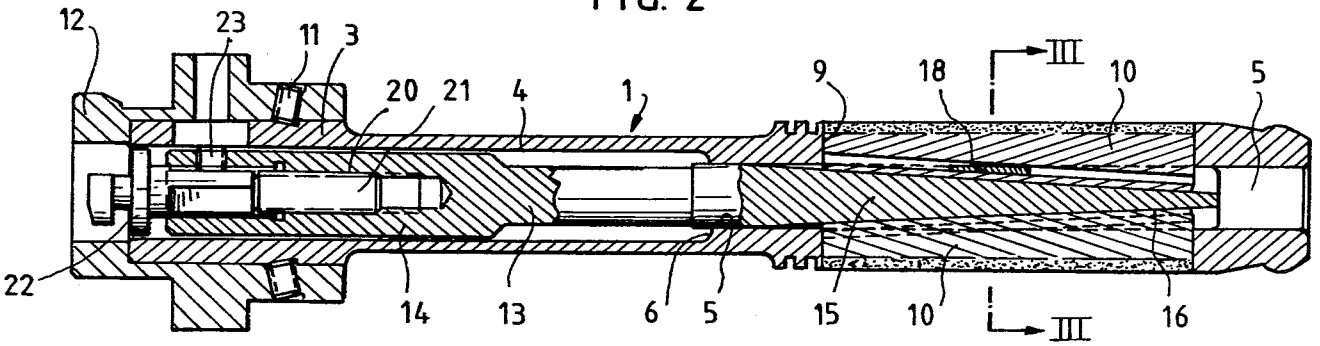
FIG. 2 is an axial sectional view taken on line II—II of FIG. 3.

As clearly seen in FIG. 2, segments 18 have cylindrical outer surfaces with only their inner surfaces converging frustoconically in the forward direction. Only these inner surfaces are needed for a retraction of the bars 10 whose outward shift is effected by the bottoms of guide grooves 16, thanks to their inclination to the sleeve axis.

I claim:

1. A grinding tool comprising:

a generally cylindrical sleeve provided with a plurality of mutually parallel longitudinal slots extending in an axial direction thereof;

a plurality of bars of wedge-shaped outline respectively penetrating said slots, with freedom of radial shifting therein, said bars having abrasive outer faces and sloping inner faces inclined to the axial direction, said bars further having lateral flanks with mortises paralleling said inner faces;

a mandrel axially displaceable in said sleeve and provided with a plurality of sloping guide surfaces, of the same inclination as said inner faces, in contact with the latter; and a plurality of ring segments secured to said mandrel in an annular zone thereof with lateral edges respectively projecting above said guide surfaces and engaging in said mortises of the bars respectively in contact therewith for positively shifting said bars upon a displacement of said mandrel in either axial direction.

2. A grinding tool as defined in claim 1 wherein said guide surfaces are the bottoms of longitudinal grooves respectively aligned with said slots, said annular zone being a frustoconical bottom of a peripheral groove of said mandrel having generatrices parallel to said mortises and said guide surfaces, said peripheral groove intersecting said longitudinal grooves and being shallower than the latter, said segments having inner surfaces complementary to the bottom of said peripheral groove.

3. A grinding tool as defined in claim 2 wherein said segments have cylindrical outer surfaces.

4. A grinding tool as defined in claim 1, 2 or 3, further comprising coupling means for adjustably immobilizing said mandrel in a selected axial position relative to said sleeve.

* * * * *